US010614792B2

(12) United States Patent
Mason

(10) Patent No.: US 10,614,792 B2
(45) Date of Patent: Apr. 7, 2020

(54) METHOD AND SYSTEM FOR USING A VOCAL SAMPLE TO CUSTOMIZE TEXT TO SPEECH APPLICATIONS

(71) Applicant: Paul Wendell Mason, La Plata, MD (US)

(72) Inventor: Paul Wendell Mason, La Plata, MD (US)

(73) Assignee: Paul Wendell Mason, LaPlata, MD (US)

( * ) Notice: Subject to any disclaimer, the term of this patent is extended or adjusted under 35 U.S.C. 154(b) by 0 days.

(21) Appl. No.: 15/822,486

(22) Filed: Nov. 27, 2017

(65) Prior Publication Data

US 2018/0075838 A1 Mar. 15, 2018

Related U.S. Application Data

(63) Continuation of application No. 14/757,028, filed on Nov. 10, 2015, now Pat. No. 9,830,903.

(51) Int. Cl.

| | |
|---|---|
| ***G10L 13/00*** | (2006.01) |
| ***G10L 13/027*** | (2013.01) |
| ***G10L 13/033*** | (2013.01) |
| ***G10L 13/04*** | (2013.01) |
| ***G10L 21/007*** | (2013.01) |
| ***G10L 25/48*** | (2013.01) |
| *G10L 21/013* | (2013.01) |

(52) U.S. Cl.

CPC ..... *G10L 13/027* (2013.01); *G10L 13/0335* (2013.01); *G10L 13/043* (2013.01); *G10L 21/007* (2013.01); *G10L 25/48* (2013.01); *G10L 2021/0135* (2013.01)

(58) Field of Classification Search

CPC ..... G10L 13/00; G10L 13/027; G10L 13/033; G10L 13/0335; G10L 13/043; G10L 13/06; G10L 13/08; G10L 13/10; G10L 15/00; G10L 2015/025; G10L 2015/1807; G10L 2015/26

See application file for complete search history.

(56) References Cited

U.S. PATENT DOCUMENTS 5,724,420 A * 3/1998 Torgrim ..... H04M 3/51 379/265.07
5,727,120 A * 3/1998 Van Coile ..... G10L 13/02 704/206
5,875,427 A * 2/1999 Yamazaki ..... G10L 21/06 704/258
5,978,765 A * 11/1999 Nagata ..... G06F 3/165 704/225
6,070,138 A * 5/2000 Iwata ..... G06Q 10/107 704/260

(Continued)

FOREIGN PATENT DOCUMENTS

EP 1703492 A1 * 9/2006 ..... G10L 19/0018
EP 1804237 * 8/2007

*Primary Examiner* — Edgar X Guerra-Erazo
(74) *Attorney, Agent, or Firm* — Duane Morris LLP

(57) ABSTRACT

Apparatus and methods consistent with the present invention measure one or more of the characteristics of a voice recording and use such measurements to create a synthetic voice that approximates the recorded voice and uses such created synthetic voice to verbalize the content of an electronically conveyed written message such as an SMS text message. The vocal characteristics measured may include frequency, timbre, intensity, rhythm, and rate of speech as well as others.

20 Claims, 1 Drawing Sheet

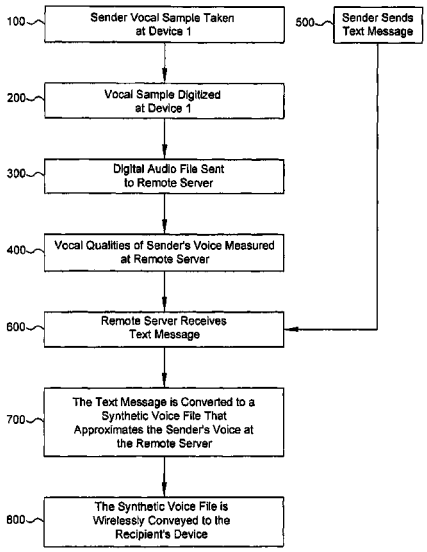

(56) References Cited

U.S. PATENT DOCUMENTS 6,098,041 A * 8/2000 Matsumoto ..... G10L 13/02 704/260
6,175,821 B1 * 1/2001 Page ..... G10L 13/00 704/258
6,246,983 B1 * 6/2001 Zou ..... H04L 51/066 379/88.16
6,775,651 B1 * 8/2004 Lewis ..... H04M 3/5307 379/88.01
6,801,931 B1 * 10/2004 Ramesh ..... G06Q 10/107 704/260
7,921,013 B1 * 4/2011 Ostermann ..... G06F 17/241 704/258
8,750,463 B2 * 6/2014 Doulton ..... G10L 15/265 379/88.01
8,976,944 B2 * 3/2015 Doulton ..... H04M 3/4936 379/88.01
8,995,974 B2 * 3/2015 Engelhart, Sr. ..... G10L 15/26 379/100.13
2002/0128838 A1 * 9/2002 Veprek ..... G10L 13/033 704/258
2003/0028380 A1 * 2/2003 Freeland ..... G10L 13/00 704/260
2003/0159566 A1 * 8/2003 Sater ..... G10H 1/0058 84/615
2004/0111271 A1 * 6/2004 Tischer ..... G10L 13/033 704/277
2005/0203743 A1 * 9/2005 Hain ..... G06F 3/167 704/258
2007/0174396 A1 * 7/2007 Kumar ..... G06Q 10/107 709/206
2007/0288478 A1 * 12/2007 DiMaria ..... G06F 16/68
2008/0040227 A1 * 2/2008 Ostermann ..... G06Q 30/02 705/14.67
2008/0235024 A1 * 9/2008 Goldberg ..... G10L 13/033 704/260
2012/0253816 A1 * 10/2012 Niemeyer ..... G10L 13/02 704/260
2017/0018272 A1 * 1/2017 Lee ..... H04N 21/4394

* cited by examiner

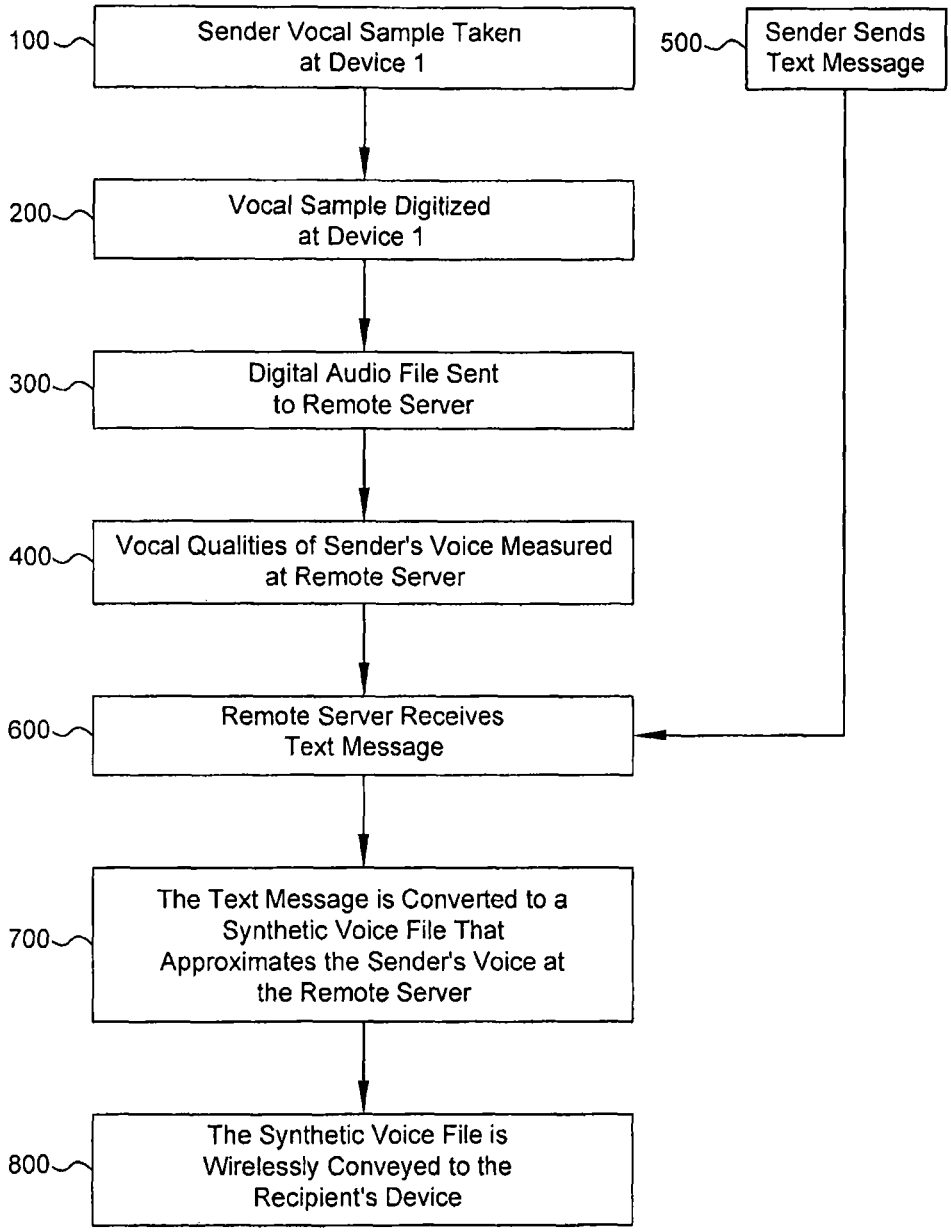
100
Sender Vocal Sample Taken at Device 1
500
Sender Sends Text Message
200
Vocal Sample Digitized at Device 1
300
Digital Audio File Sent to Remote Server
400
Vocal Qualities of Sender's Voice Measured at Remote Server
600
Remote Server Receives Text Message
700
The Text Message is Converted to a Synthetic Voice File That Approximates the Sender's Voice at the Remote Server
800
The Synthetic Voice File is Wirelessly Conveyed to the Recipient's Device

METHOD AND SYSTEM FOR USING A VOCAL SAMPLE TO CUSTOMIZE TEXT TO SPEECH APPLICATIONS

CROSS-REFERENCE TO RELATED APPLICATIONS

This application is a continuation of and claims priority to U.S. patent application Ser. No. 14/757,028, titled "Method and System for Using a Vocal Sample to Customize Text to Speech Applications," filed Nov. 10, 2015, now U.S. Pat. No. 9,830,903, the entirety of which is incorporated herein by reference.

BACKGROUND OF THE INVENTION

This invention relates generally to the fields of speech synthesis and wireless communications.

Various voice-user interfaces are known in the art including voice to text applications such as Nuance Dragon Naturally Speaking. Similarly, various text to voice applications are known in the art. For example, the Apple iOS operating system includes a voice-based application known as Siri which has both voice to text and text to speech functionality.

SMS text messaging, instant messaging (IM), electronic mail, and other text message applications are well known in the field of telecommunications. Such applications use standardized communications protocols to allow personal computers and/or mobile handsets to exchange short text messages. Applications for converting text messages to speech, such as Google Text-to-Speech, are known in the art. Known text to speech applications employ synthetic voices to verbalize the content of the text message. Such applications may permit a range of voices as to the preferred synthetic voice, however such voices are not typically customizable to a particular human being.

The present invention permits a text to speech application to use a recorded sampling of the sender's voice to customize the speech output such that it is rendered in the sender's voice.

SUMMARY OF THE INVENTION

Systems, apparatus and methods consistent with the present invention measure one or more of the characteristics of a voice recording and use such measurements to create a synthetic voice that approximates the recorded voice and uses such created synthetic voice to verbalize the content of an electronically conveyed written message such as an SMS text message. The vocal characteristics measured may include frequency, timbre, intensity, rhythm (duration of pauses) and rate of speech as well as others.

The average human speaking voice covers a frequency range of approximately 300 Hz to 3500 Hz. When measuring the frequency of a vocal sample, preferably the sampling frequency should be at least at the Nyquist rate, which is two times the maximum frequency of the greatest frequency of the vocal sample. In order to capture the timbre of a speaker's voice, the sampling frequency may be considerably higher than the Nyquist rate. As a point of reference, sound is recorded to Compact Discs at a sampling frequency of 44,100 Hz.

Adult human speech is typically spoken at a rate of about 5 to 8 syllables per second. Sentences of less than 16 syllables are generally produced without any internal pause, but there is a rapid rise in accumulated pause silence from 200 ms at 20 syllables to an accumulated pause silence on the order of 800 ms at 40 syllables. (Fant et al. *Individual Variations in Pausing. A Study of Read Speech*, PHONUM 9 (2003), 193-196.) In order to account for variations in the number of pauses as well as other variations, in a preferred embodiment, the recording of the voice to be sampled and rendered is of some predetermined sequence of words. Use of a common word sequence may further reduce differences in pitch inherent to different sequences of words arising from consonant sounds being higher pitched than vowel sounds. Additionally, it will aid in the detection of varied or non-standard pronunciations. In another embodiment, the sender's voice mail greeting is used to provide the vocal sample. Where the sender's voice mail greeting is used to provide the vocal sample, the entire greeting or just a portion of predetermined duration may be used.

Various types of speech synthesis may be used by text-to-speech engines. These include articulatory synthesis, formant synthesis and concatenative synthesis. In formant synthesis collections of signals are composed to form recognizable speech. One previously commercially available text-to-speech engine employing formant synthesis is DECTalk. In concatenative synthesis short samples of recorded sound are combined.

A voice that is considered to have neutral vocal characteristics may be modified by the speech-to-text engine in various ways in order to create a synthetic voice. This may include modification of the pitch, intensity, rhythm and rate and other characteristics. The pitch (or other characteristics) of the neutral voice need not be changed uniformly. Rather, phonemes may be adjusted individually.

BRIEF DESCRIPTION OF THE DRAWING

The accompanying drawing, which is incorporated in and constitutes a part of this specification, illustrates one embodiment of the invention and serves to explain the principles of the invention. In the drawing:

FIG. 1 is a block diagram of the method consistent with the methods and computer readable instructions of the present invention.

DETAILED DESCRIPTION OF THE PREFERRED EMBODIMENT

FIG. 1 is a flowchart showing steps for practicing an embodiment of the present invention. As a first step 100 the person who will ultimately send the message, the sender, provides a vocal sample at a first device. As a second step 200 the vocal sample is digitized at such first device. As a third step 300 the digital audio file is sent from such first device to a remote server. As a fourth step 400 the vocal qualities of the sender's voice are measured at the remote server. As a fifth step 500 the sender sends a text message addressed to a recipient. As a sixth step 600 the text message is received at the remote server. As a seventh step 700 the text message is converted to a synthetic voice file that approximates the sender's voice at the remote server. As an eighth step 800 the synthetic voice file is conveyed wirelessly to the recipient's device.

In an embodiment of the present invention, the sender first provides a vocal sample that is recorded using a device, typically a mobile device. Preferably such vocal sample is recorded at a sampling rate of 44,100 Hz. This vocal sample is converted to a digital format by the first device. Such format may be, for example, MP3 or MP4. The audio file may be compressed for transfer using, for example, Advanced Audio Coding. The audio file is conveyed, typically wirelessly, to a remote server where its vocal qualities, which may include frequency, timbre, intensity, rhythm and/or rate of speech, are measured. Subsequently, the sender may send a text message to a recipient. Such text message may be converted to speech using known means. Such speech may be customized to model the vocal characteristics of the sender of the message.

More particularly, such text message may be conveyed to a remote server as a text file and converted at the remote server to a synthetic voice that approximates the sender's voice. The remote server may include a processor and a computer readable storage medium such as a hard drive or solid state drive. The remote server may further include a text-to-speech engine, a client application interface, a voice gateway, a messaging gateway and a software module written in computer code and running on the processor. The software module may implement the processes described herein to control the operation of the server and may be stored in the computer readable storage medium. The software module may coordinate the operations of the text-to-speech engine, client application interface, voice gateway, and messaging gateway. The text-to-speech engine may employ formant synthesis where the synthesized speech output is created using additive synthesis. In the alternative, it may employ concatenative synthesis where the diphones are appropriately adjusted so as to model the characteristics of the sender's voice.

A signal conveying the text message as converted to a synthetic voice that approximates the sender's voice is then sent to the recipient's device. In another embodiment, the information corresponding to the text message in synthetic voice format may be stored remotely until called for by the recipient.

In an alternative embodiment, conversion of the message to a synthetic voice that approximates the sender's voice may occur at a sender's mobile device or a recipient's mobile device.

In one embodiment, the person whose voice will be approximated may speak some predetermined sequence of words in order to provide a common vocal sample such that variations from average speech may be identified more readily. Such predetermined sequence of words may be short such that there are few or no pauses or may be longer. In another embodiment, the vocal sample may be derived from the sender's voice mail greeting. The voice mail greeting may be accessed by an application on the sender's phone or, alternatively, an application on the recipient's phone may access such greeting telephonically. Where the voice mail greeting is accessed by an application on the sender's phone the greeting may be sent wirelessly to a remote server for measurement and analysis.

In a further embodiment, the application may search a voice mail greeting for words or phrases commonly used in such context. In the English language, such words or phrases may include, for example, "hi," "hello," "this is," "leave a message" and/or "get back to you." Once identified, these words and phrases may be evaluated by reference to such words as spoken by a person with a neutral speech pattern to facilitate creation of a synthetic voice that approximates the sender's voice.

In another embodiment, the application may express acronyms, such as "LOL," or abbreviated terms as fully articulated phrases. In yet another embodiment, the application may be programmed so as not to verbalize profane words.

As used herein, the term "sender" means a person who sends a textual message via electronic means.

It is to be understood that even though numerous characteristics and advantages of the present invention have been set forth in the foregoing description, together with details of the structure and function of the invention, the disclosure is illustrative only, and changes may be made in detail within the principles of the invention to the full extent indicated by the broad general meaning of the terms in which the appended claims are expressed.

What is claimed is:

1. A method comprising:

receiving, via a client application interface, a recorded sample of a sender's voice;

measuring the vocal characteristics of the recorded sample of the sender's voice including its frequency, intensity, rhythm and rate of speech;

receiving a text-based message originating from the sender;

converting the text-based message to a speech format wherein the measured vocal characteristics are used to form a synthetic voice that approximates the voice of the sender; and sending an audio file of the sender's message as converted to an address that corresponds to the address of the text-based message.

2. The method of claim 1 wherein the recorded sample of the sender's voice is made by sampling at a rate of at least 40,000 Hertz.

3. The method of claim 1 wherein the sample of the sender's voice consists of a sequence of predetermined words.

4. The method of claim 3 wherein the recorded sample is at least 20 syllables long.

5. The method of claim 1 wherein the sample of the sender's voice comprises the sender's voicemail greeting.

6. The method of claim 5 wherein the sender's voicemail greeting is accessed telephonically.

7. The method of claim 1 wherein one or more acronyms in the text-based message are audibly expressed as full words or phrases.

8. The method of claim 1 wherein the measured vocal characteristics include timbre.

9. The method of claim 1 wherein profane words are filtered out of the audio file of the sender's message.

10. A method, comprising:

recording, with a sender device, a sample of a sender's voice;

receiving, with a receiving device, the recorded sample of the sender's voice from the sender device;

measuring, with the receiving device, the vocal characteristics of the recorded sample of the sender's voice including frequency, intensity, rhythm, and rate of speech;

receiving, with the receiving device, a text-based message from the sender device;

converting, with the receiving device, the text-based message to an audio message wherein the audio message comprises a synthetic voice that approximates the vocal characteristics as measured from the recorded sample of the sender's voice.

11. The method of claim 10, further comprising:

sending, with the receiving device, the audio message to a second receiving device.

12. The method of claim 10 wherein the recorded sample of the sender's voice is made by sampling at a rate of at least 40,000 Hertz.

13. The method of claim 10 wherein the sample of the sender's voice consists of a sequence of predetermined words.

14. The method of claim 13 wherein the recorded sample is at least 20 syllables long.

15. The method of claim 10 wherein the sample of the sender's voice comprises the sender's voicemail greeting.

16. The method of claim 15 wherein the sender's voicemail greeting is accessed telephonically.

17. The method of claim 10 wherein one or more acronyms in the text-based message are audibly expressed as full words or phrases.

18. The method of claim 10 wherein the measured vocal characteristics include timbre.

19. The method of claim 10 wherein profane words are filtered out of the audio file of the sender's message.

20. The method of claim 10, wherein said converting step comprises using formant synthesis.

* * * * *